US009004622B2

(12) United States Patent
Garcia et al.

(10) Patent No.: US 9,004,622 B2
(45) Date of Patent: Apr. 14, 2015

(54) APPARATUS FOR ADJUSTING THE HEIGHT OF A COUNTER WHICH IS GUIDED IN A HOUSEHOLD DEVICE BY WAY OF AT LEAST ONE PULL-OUT GUIDE

(75) Inventors: Oscar Garcia, San Sebastian (ES); Eqaut Arriaga, Ursubil (ES); Ilker Lopetegi, Zarautz (ES); Mikel Azkue, Zarautz (ES)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 803 days.

(21) Appl. No.: 13/259,700

(22) PCT Filed: Apr. 16, 2010

(86) PCT No.: PCT/EP2010/055036

§ 371 (c)(1),
(2), (4) Date: Dec. 5, 2011

(87) PCT Pub. No.: WO2010/124947

PCT Pub. Date: Nov. 4, 2010

(65) Prior Publication Data

US 2012/0074080 A1 Mar. 29, 2012

(30) Foreign Application Priority Data

Apr. 30, 2009 (DE) ..... 20 2009 004 771 U

(51) Int. Cl.

| | |
|---|---|
| ***A47L 15/50*** | (2006.01) |
| ***A47B 46/00*** | (2006.01) |
| ***F24C 15/16*** | (2006.01) |

(52) U.S. Cl.

CPC ..... *A47L 15/506* (2013.01); *A47B 46/005* (2013.01); *A47L 15/507* (2013.01); *F24C 15/168* (2013.01)

(58) Field of Classification Search

CPC ..... A47L 15/50; A47L 15/504; A47L 15/506; A47L 15/507

USPC ..... 312/228.1, 319.2, 311, 322, 323, 334.6, 312/334.7, 334.8, 350

See application file for complete search history.

(56) References Cited

U.S. PATENT DOCUMENTS

| | | | |
|---|---|---|---|
| 2,919,966 | A | 1/1960 | Preston |
| 5,462,347 | A | 10/1995 | Vogelgesang et al. |
| 2005/0206282 | A1 | 9/2005 | Walburn |
| 2006/0066189 | A1 | 3/2006 | Bond et al. |
| 2008/0129168 | A1 | 6/2008 | Banta et al. |

FOREIGN PATENT DOCUMENTS

| | | |
|---|---|---|
| DE | 601 18 237 | 12/2006 |
| DE | 1 02005 054 604 | 5/2007 |
| WO | 2010/124947 | 11/2010 |

OTHER PUBLICATIONS

German Search Report corresponding to Application No. DE 20 2009 004 771.7 106.7 dated Apr. 30, 2009.

*Primary Examiner* — Michael Safavi
(74) *Attorney, Agent, or Firm* — Barnes & Thornburg LLP

(57) ABSTRACT

An apparatus for adjusting the height of at least one counter, the at least one counter being guided in a household device by at least one pull-out guide. The apparatus includes at least one sliding rail on which the at least one counter is guidable and configured to be pulled out in a pull-out direction. Also included is a height adjustment mechanism configured to be fixed to opposing side walls of the household device. The height adjustment mechanism includes two arms which are rotatably fixed to each of the side walls. Further included are two guide rails fixable to respective second ends of the arms in a rotatable manner parallel to the plane of the side walls and an energy storage device is fixed to at least one of the opposing side walls of the household device.

11 Claims, 13 Drawing Sheets

APPARATUS FOR ADJUSTING THE HEIGHT OF A COUNTER WHICH IS GUIDED IN A HOUSEHOLD DEVICE BY WAY OF AT LEAST ONE PULL-OUT GUIDE

This application is a national stage of International Application PCT/EP2010/055036, filed Apr. 16, 2010, and claims benefit of and priority to German Patent Application No. 20 2009 004 771.7, filed Apr. 30, 2009, the content of which Applications are incorporated by reference herein.

BACKGROUND AND SUMMARY

The present disclosure relates to an apparatus for adjusting the height of at least one counter guided in a household device by way of at least one pull-out guide.

Conventional household devices, such as a dishwasher or a baking oven, comprise a counter which is guided by way of at least one pull-out guide. The counter may be arranged on a dishwasher rack or on a cooking item support. Such counters are only displaceable in one horizontal plane out of the household device or back into the household device.

Such household devices usually stand on the floor of a room, so that a user is forced to bend over in order to load or unload the counter and to thereby burden his or her back muscles and spine in a fairly considerable way.

Apparatuses for adjusting the height of such counters of a household device are known from the state of the art, in which the counters can be lifted by a drive such as a belt drive, for example, leading to additional costs for the drive and its installation. Alternative apparatuses, without any additional drive, need to be lifted manually with a large application of force by the user.

It is within the scope of the present disclosure to provide for and to further develop an apparatus for height adjustment of a counter guided in a household device by way of at least one pull-out guide. Such an apparatus is developed in such a way that the lifting and lowering of the counter is enabled without any additional driving means and still without any major application of force.

This present disclosure provides for an apparatus for adjusting the height of a counter guided in a household device by way of at least one pull-out guide. The apparatus includes at least one sliding rail on which the at least one counter is guidable and configured to be pulled out in a pull-out direction and a height adjustment mechanism that is configured to be fixed to opposing side walls of the household device. The height adjustment mechanism includes two arms which are rotatably fixed to each of the side walls with first ends of the arms being parallel to a plane of the side walls and arranged to be spaced parallel with respect to each other. Further included are two guide rails fixable to respective second ends of the arms in a rotatable manner parallel to the plane of the side walls in such a way that the guide rails are configured to be lifted from a bottom position in the household device to an upper position, and an energy storage device is fixed to at least one of the opposing side walls of the household device. The energy storage device is in operative connection with one of the arms fixed to the at least one opposing side wall in such a way that one of a lifting and lowering of the guide rails is supportable by energy stored in the energy storage device.

As noted above, in accordance with the present disclosure, an energy storage device is fixed to at least one of the opposing side walls of the household device. The energy storage device is operatively connected to one of the arms fixed to the side wall such that a lifting or lowering of the counter can be supported by the energy stored in the energy storage device.

This solution, in accordance with the present disclosure, produces a very good cost/benefit ratio, since no drive, to be installed with high costs and in a time-consuming manner, is necessary, on the one hand, and the energy storage device supports the adjustment of the counter caused by the user in an energy-saving way, on the other hand.

Advantageous aspects of the apparatuses of the present disclosure are discussed herein and in the accompanying claims.

In an embodiment of the present disclosure the arms and the energy storage device are not fixed directly to the opposing side walls, but at least to one of the opposing side walls of the household device by way of a side wall fixture. Such a side wall fixture can, according to the present disclosure, be fastened easily to such a side wall and has further advantageous features which are disclosed herein.

The energy storage device may be arranged as a tension spring in an embodiment of the present disclosure. Such a tension spring represents a highly cost-effective possibility to support the lifting and lowering of the counter.

In a further embodiment, according to the present disclosure, a guide is provided on the side of the side wall fixture which faces away from the side wall of the household device, in which a guide element can be guided which protrudes from a head element of one of the arms. This enables a precise guidance of the arms and thus the entire lifting and lowering movement of the height adjustment mechanism.

A locking element is provided in an embodiment according to the present disclosure. The locking element is provided in at least one end region of the guide, with which the arm and thereby the entire height adjustment mechanism can be locked. This end position can concern a position, on the one hand, in which the counter is disposed completely in the household device or, on the other hand, in which the counter has reached its lifted end position. A sudden drop of the counter can effectively be prevented with such a locking element, for example.

In accordance with another embodiment according to the present disclosure, the energy storage device is fixed in a horizontally displaceable manner to the side wall of the household device. For example, a groove is provided in the holding plates in which the energy storage device can be locked in a horizontally adjustable way. The supporting power for the lifting and lowering movement of the height adjustment mechanism can be adjusted in a simple way to the local conditions with such an adjusting possibility.

Other aspects of the present disclosure will become apparent from the following descriptions when considered in conjunction with the accompanying drawings.

DETAILED DESCRIPTION

In the following description, terms such as top, bottom, left, right, front, and rear, relate to the exemplary illustrations as shown in the respective drawings and the position of the apparatus and other parts of the apparatus. These terms are not to be understood as restrictive. That is, such terms could change in various operating positions or through mirror-symmetric design of the apparatus, according to embodiments of the present disclosure.

Figure 1:
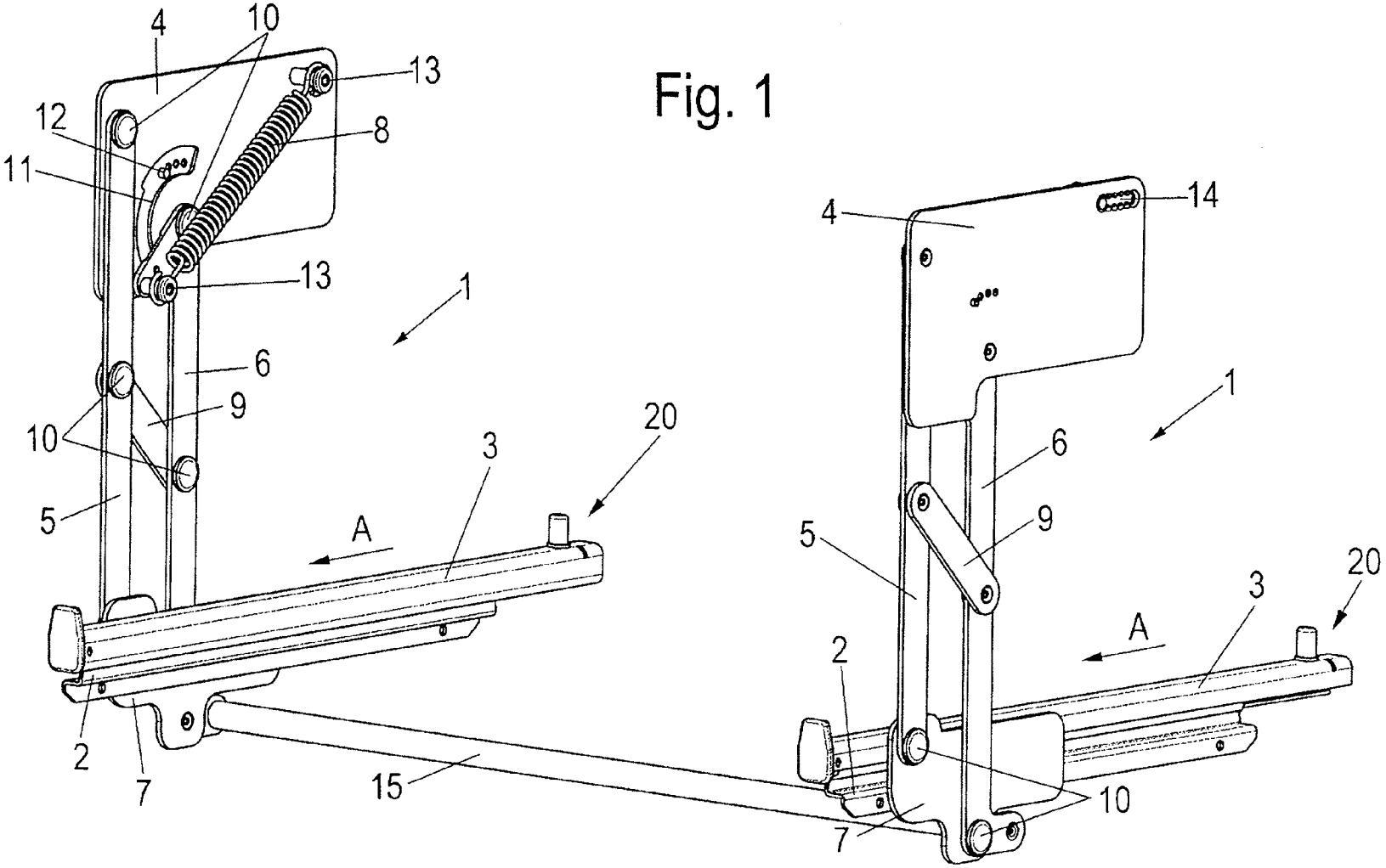
FIG. 1 shows a schematic perspective view of an embodiment of a height adjustment mechanism, according to the present disclosure.
Figure 3:
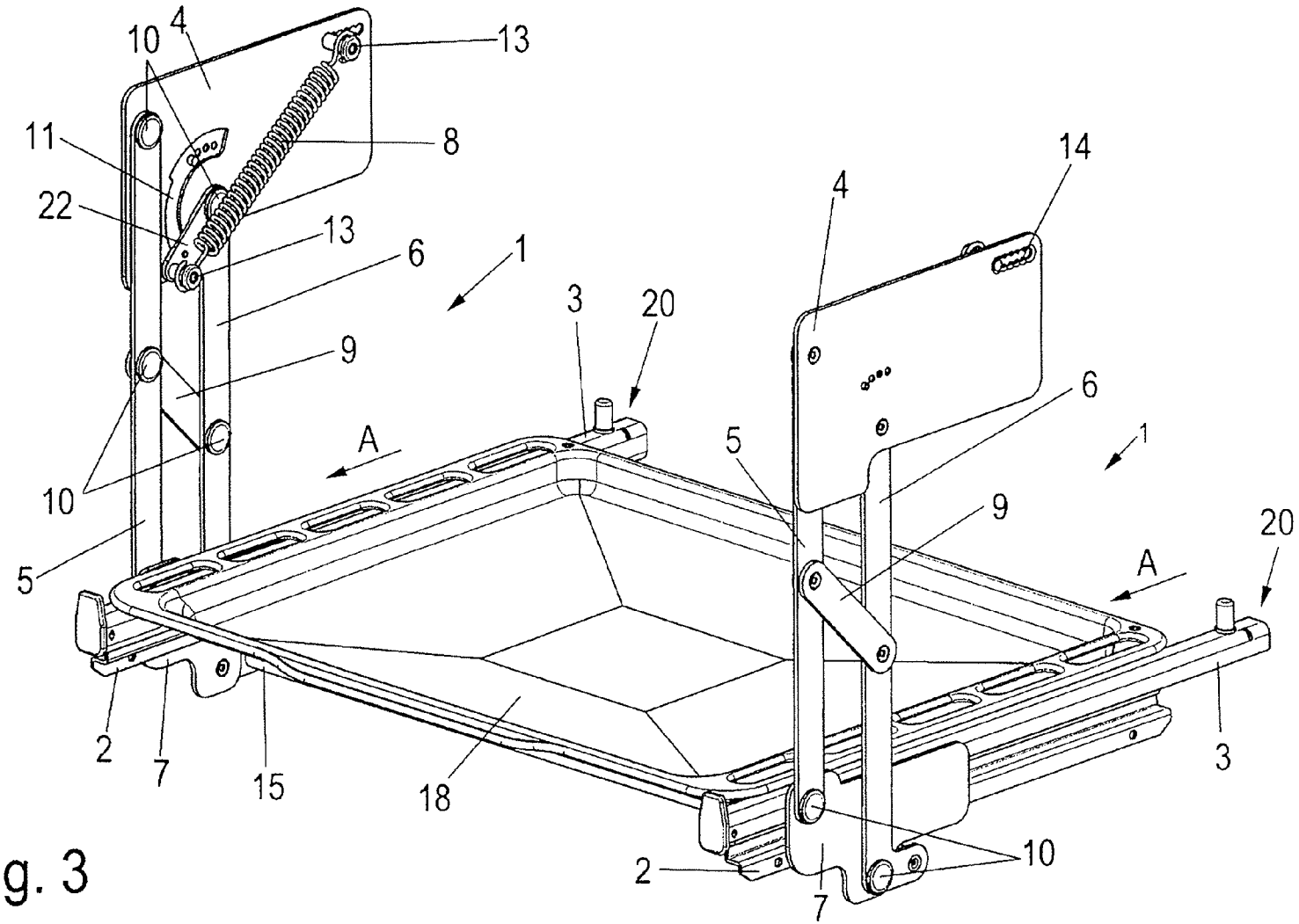
FIG. 3 shows a schematic perspective view of the embodiment of the height adjustment mechanism according to FIG. 1, and also showing a counter in the form of a cooking support, in accordance with the present disclosure.

FIG. 1 shows an embodiment of an apparatus, in accordance with the present disclosure, for adjusting the height of a counter 18, which can be in the form of a cooking item support or rack, guided in a household device by way of a pull-out guide 20. The counter 18, which is not shown in FIG. 1 (see FIG. 3) is placed to the left and the right on sliding rails 3, as seen in the pull-out direction A, or carried on or connected with rails 3, which rails 3 can be pulled on respective guide rails 2 in the pull-out direction A. FIG. 3 shows a height adjustment mechanism 1 with the counter 18 in the form of a cooking item support. A rail fixture 7 is fixed to each of the guide rails 2 perpendicularly to the pull-out direction A, on which two arms 5 and 6 are rotatably arranged with a second end by bolts 10. A first end of the arms 5, 6 are being rotatably fastened by bolts 10 to a side wall fixture 4. Each of the side wall fixtures 4 can be fastened to opposing side walls 21, 27 (not shown here) of the household device. Alternatively, according to the present disclosure, the arms 5 and 6 can also be fixed directly to the side walls 21, 27 (see FIGS. 5-8) of the household device and directly to the respective guide rail 2. The fixing of the arms 5, 6 both to the side walls 21, 27 and the side wall fixture 4 as well as the guide rails 2 and the rail fixture 7 is provided in such a way that the arms 5, 6 are rotatable parallel to the plane of the side walls 21, 27. The two arms 5, 6 on each of the side walls 21, 27 are arranged to be spaced from one another and parallel to each other. The distances of the pivots on arm 5 are equal to those of arm 6. For further stabilization of the arms 5, 6, a cross member 9 is rotatably fixed to the arms 5, 6 parallel to the pivots at the ends of the arms 5, 6 approximately at half the length of the arms 5, 6. The end of the arm 6, which is the rear one in the pull-out direction A, and which is fixed to the rail fixture 7, is bent off at an end at a right angle in relation to a main extension axis of the arm 6. The two arms 6 are arranged in a rotationally rigid manner on a cross member 15 at the tip of this bent-off end, which cross member 15 synchronizes a left and a right side.

An energy storage device 8, which, is arranged as a tension spring, for example, in this case, is fastened adjacent to the arms 5, 6 to the side wall fixture 4, which side wall fixture 4 is arranged as a holding plate. At one end, the tension spring 8 is suspended on a bolt 13 protruding perpendicularly from the side wall fixture 4. Another end of the tension spring 8 is also suspended on a bolt 13 which protrudes perpendicularly from a head element 22 of the arm 6, which toward the rear in the pull-out direction A. Head element 22 has features including the shape of a rectangle and triangle in the embodiment as shown, for example, in FIGS. 3, 11 and 12 with a leg of the triangle being arranged as an extension of the longitudinal axis of arm 6. Another leg of the triangle protrudes perpendicularly in relation to the longitudinal axis of the arm 6 in the pull-out direction A from the arm 6. The arm 6 is rotatably fastened to the side wall fixture 4 in the region of an acute angle forming an extension of the longitudinal axis of arm 6, while the bolt 13 holding the tension spring 8 is arranged in a region of another acute angle of the head element 22. The arrangement of two bolts 13 is positioned in such a way that an imaginary connecting straight line is disposed beneath the pivot of the arm 6.

Figure 4:
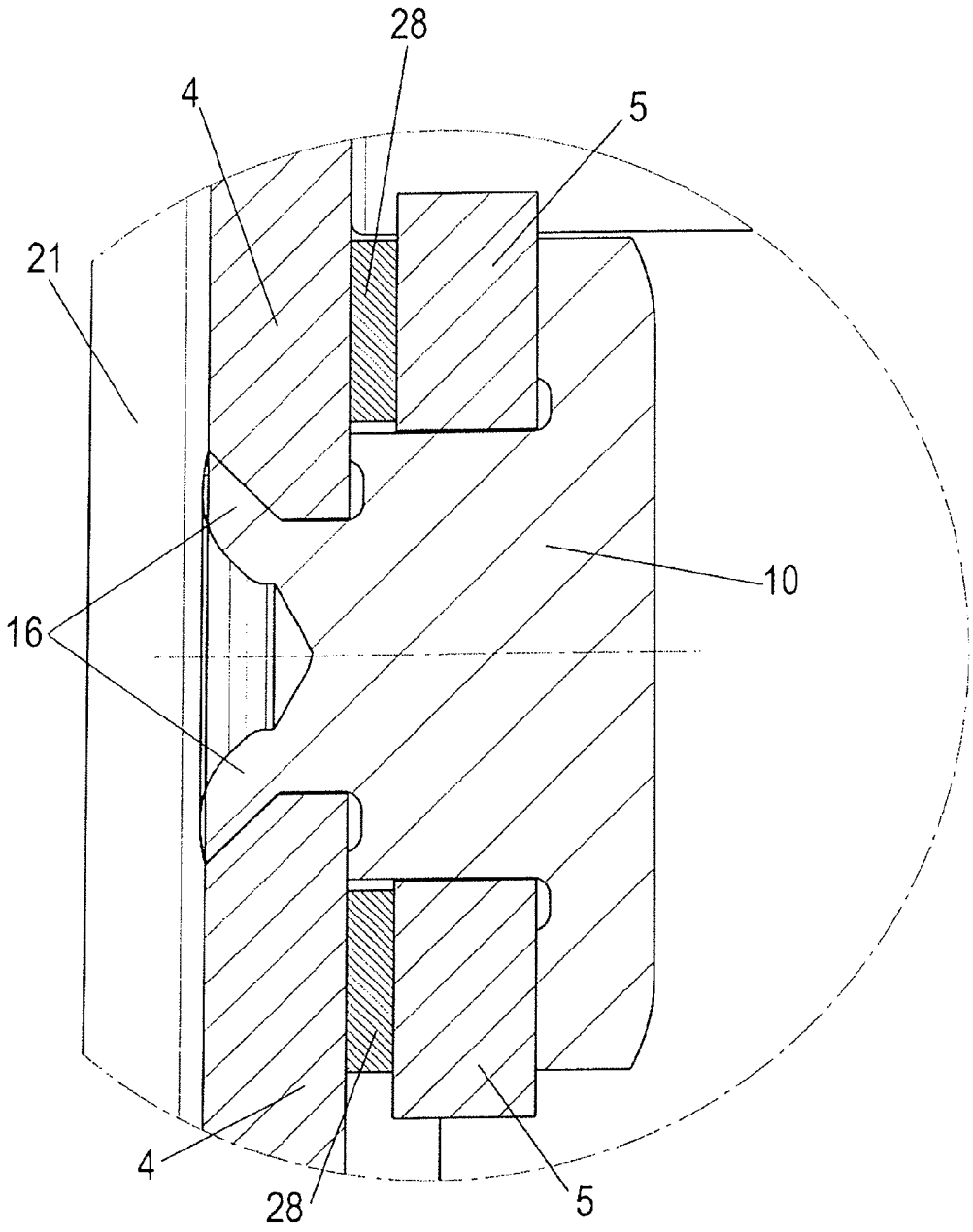
FIG. 4 shows a detailed view of a connection between arms, holding plate and side wall of a household device in a sectional view, according to the present disclosure.

The rotatable fixing of the arms 5, 6 and the cross members 9 to the side wall fixture 4, the rail fixture 7 or the arms 5, 6 themselves occurs by way of the bolts 10, of which one is shown in a sectional view in FIG. 4. As is shown in FIG. 4, the bolt 10 comprises a rivet head 16 which engages behind a chamfered bore in the side wall fixture 4. Other forms of axially securing the bolts 10 are within the scope of the present disclosure. A throat portion of the bolt 10 penetrates a bore in ends of the respective arms 5, 6. It is within the scope of the present disclosure to fix the arms 5, 6 directly in the side walls 21, 27, for example, of the household device. In order to ensure play-free rotation, an elastic intermediate layer 28 is introduced.

Figure 2:
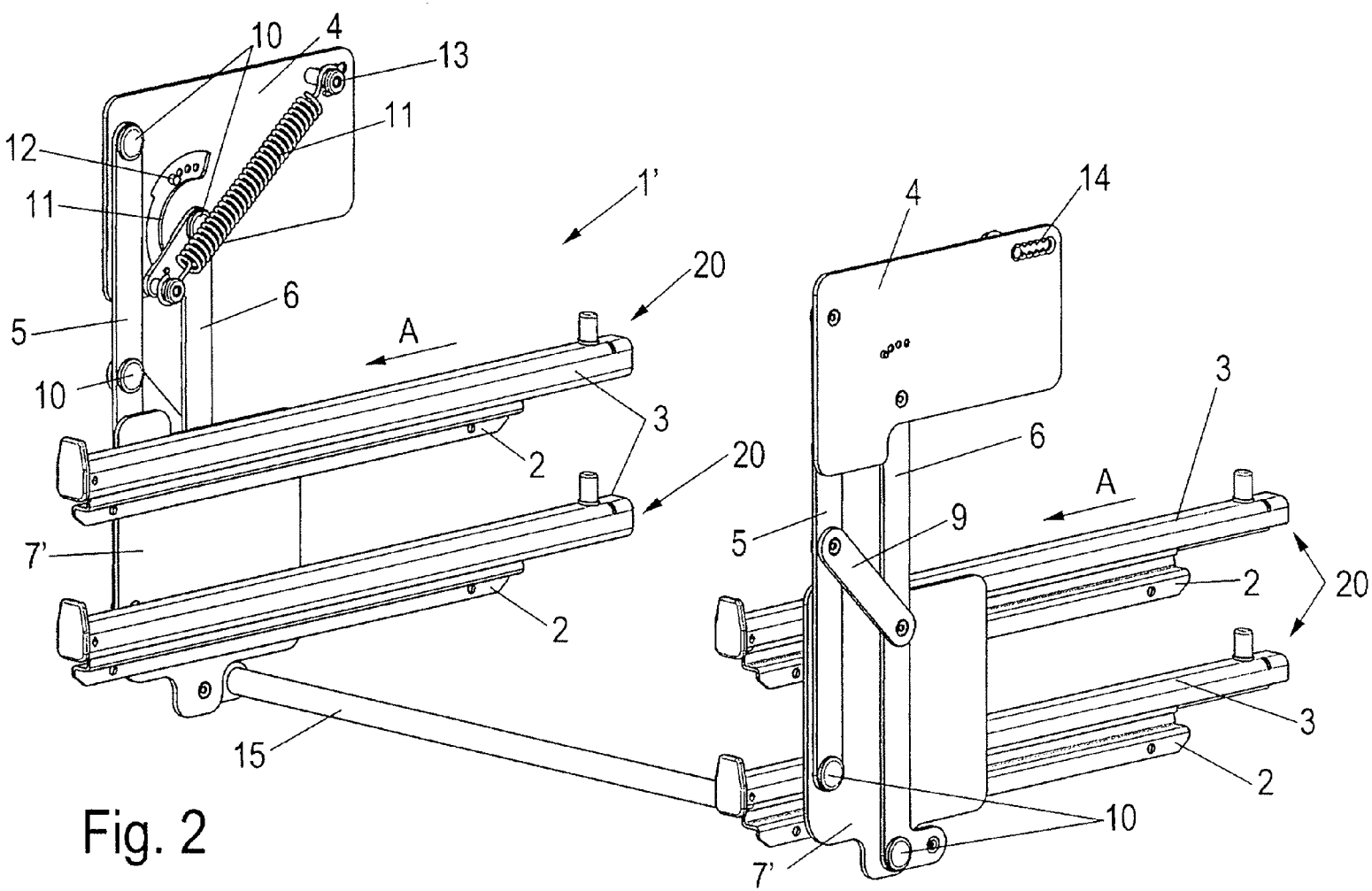
FIG. 2 shows a schematic perspective view of another embodiment of a height adjustment mechanism, according to the present disclosure.

FIG. 2 shows an embodiment of a height adjustment mechanism 1', in accordance with the present disclosure. This height adjustment mechanism includes modified side wall fixtures 4' for accommodating several pull-out guides 20. As a result, several counters 18 can be moved with this system, in accordance with the present disclosure.

A lifting process of the counter 18 is described below by reference to FIGS. 5 to 7 and 8 to 10 by the height adjustment mechanism 1, as shown in FIG. 1.

Figure 5:
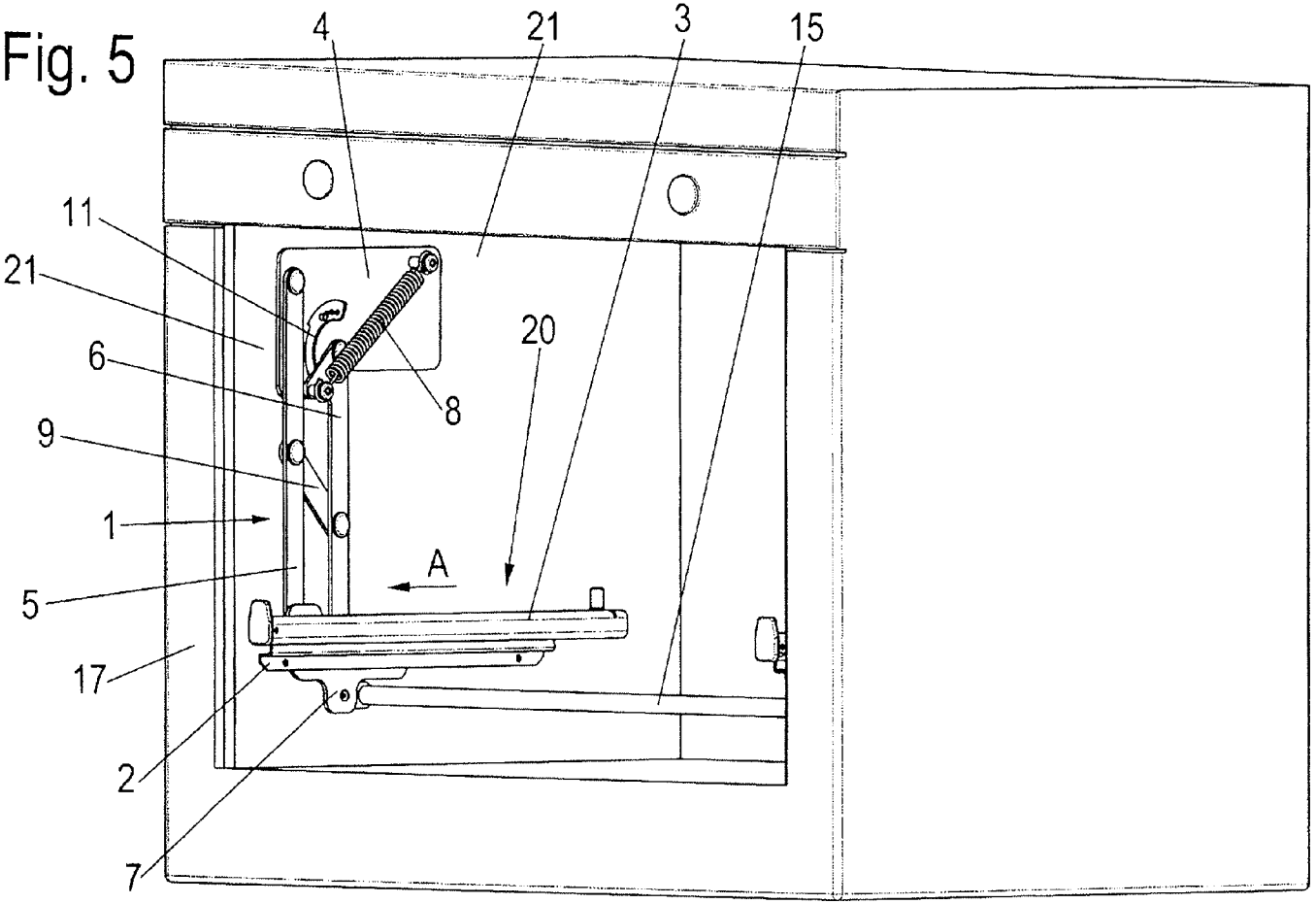
FIGS. 5 to 7 show schematic perspective views of a baking oven with a height adjustment mechanism installed therein in different positions of the height adjustment mechanism, according to an embodiment of the present disclosure.
Figure 6:
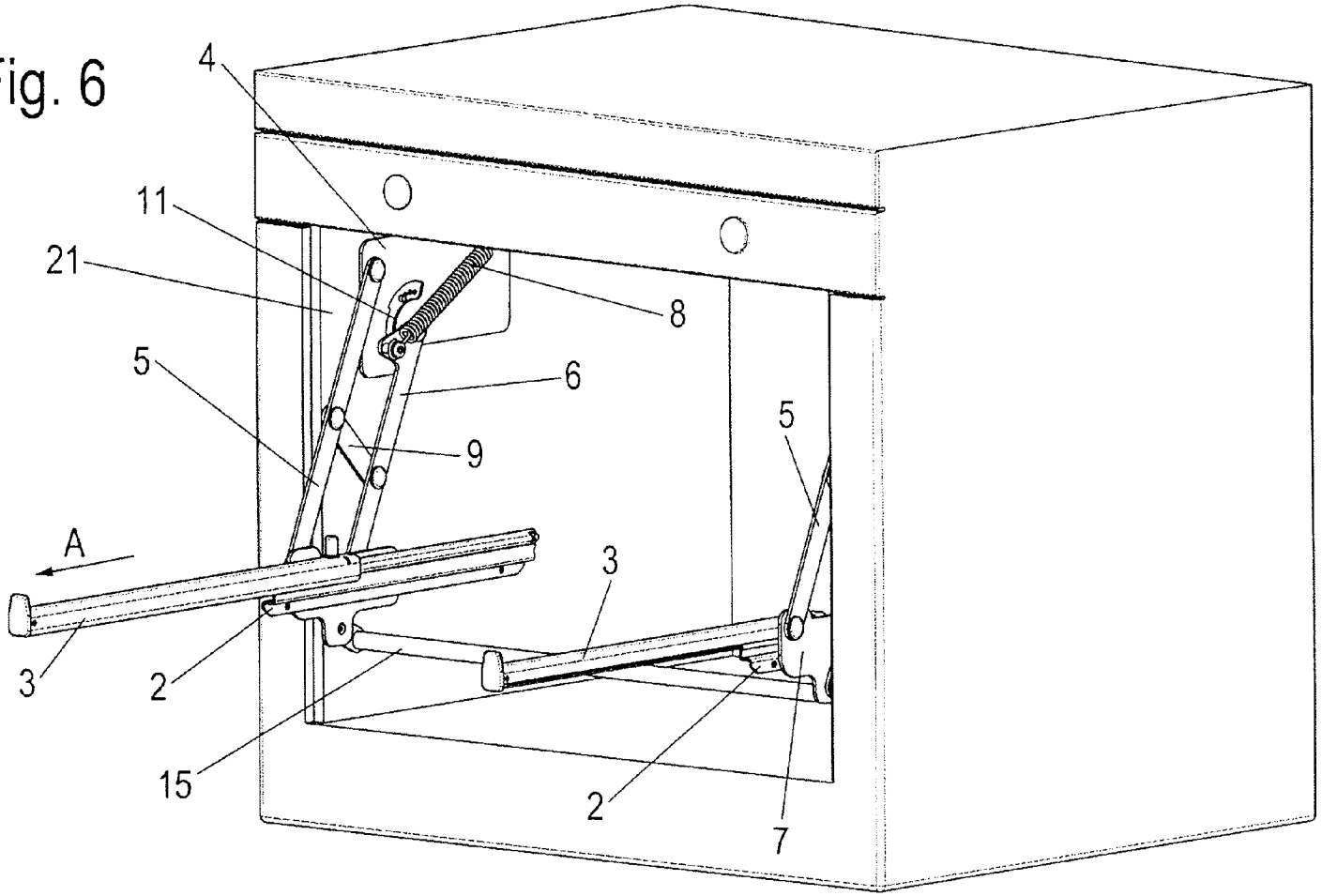
Figure 7:
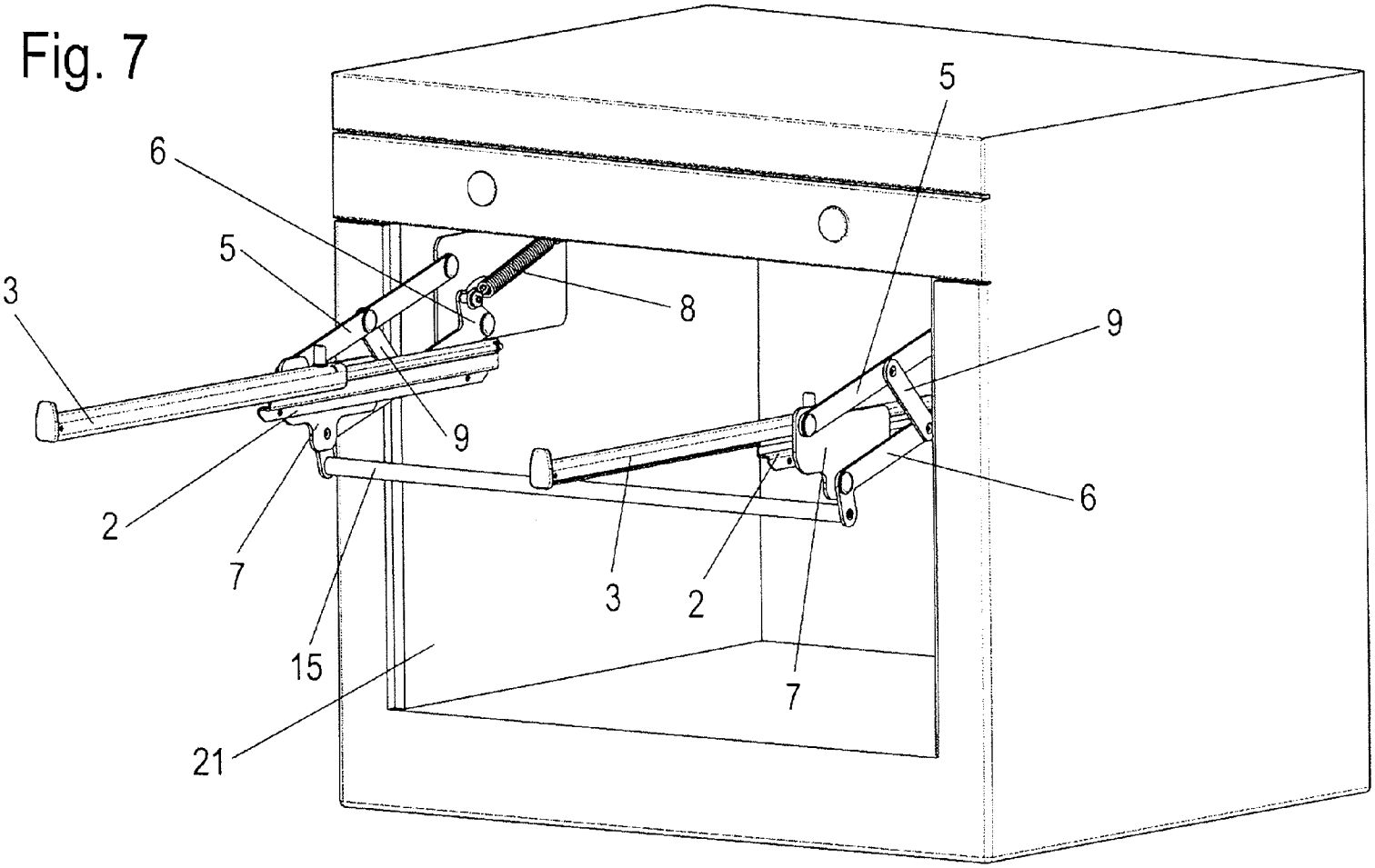
Figure 8:
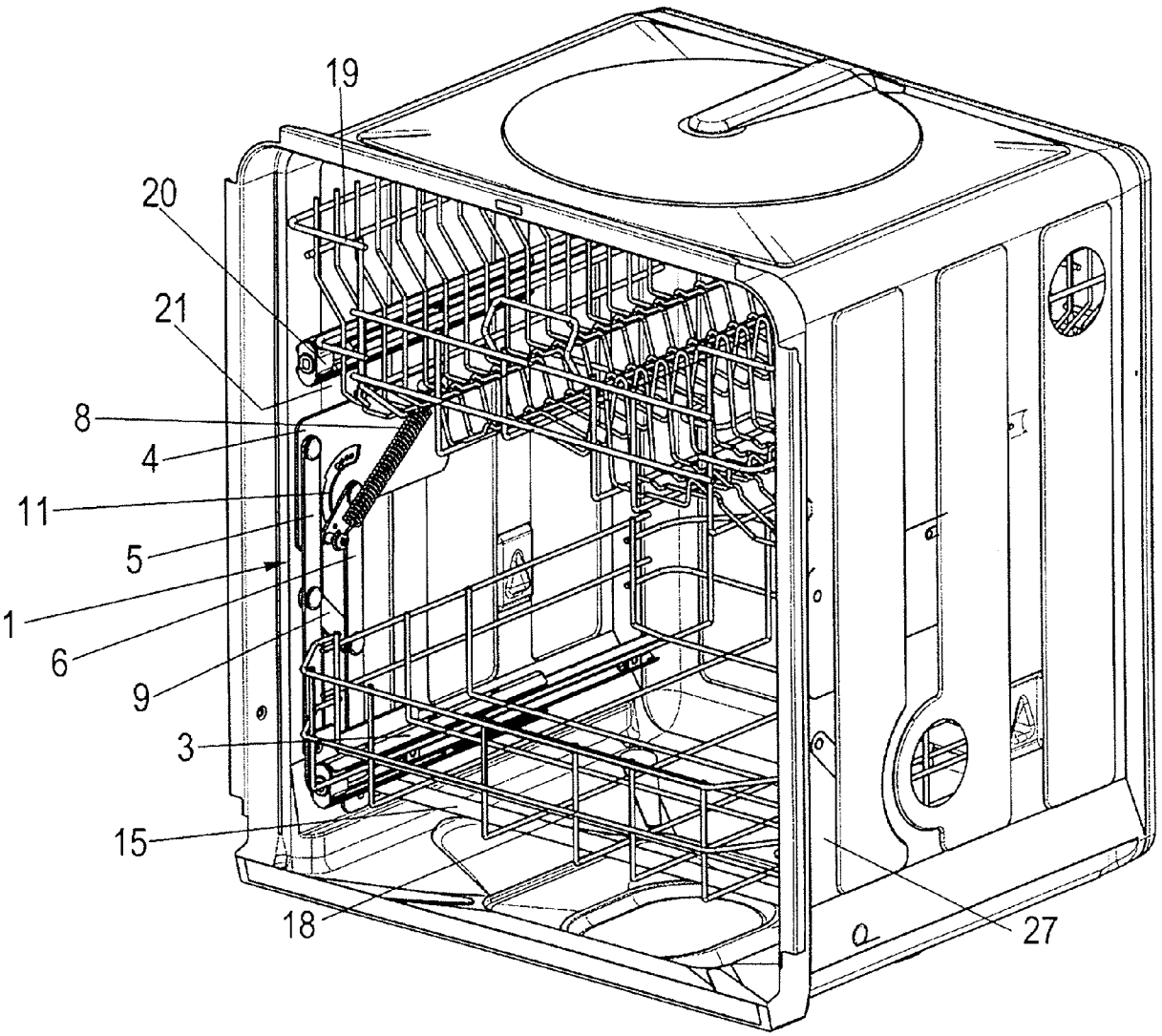
FIGS. 8 to 10 show schematic perspective views of a height adjustment mechanism installed in a dishwasher, according to an embodiment of the present disclosure.
Figure 9:
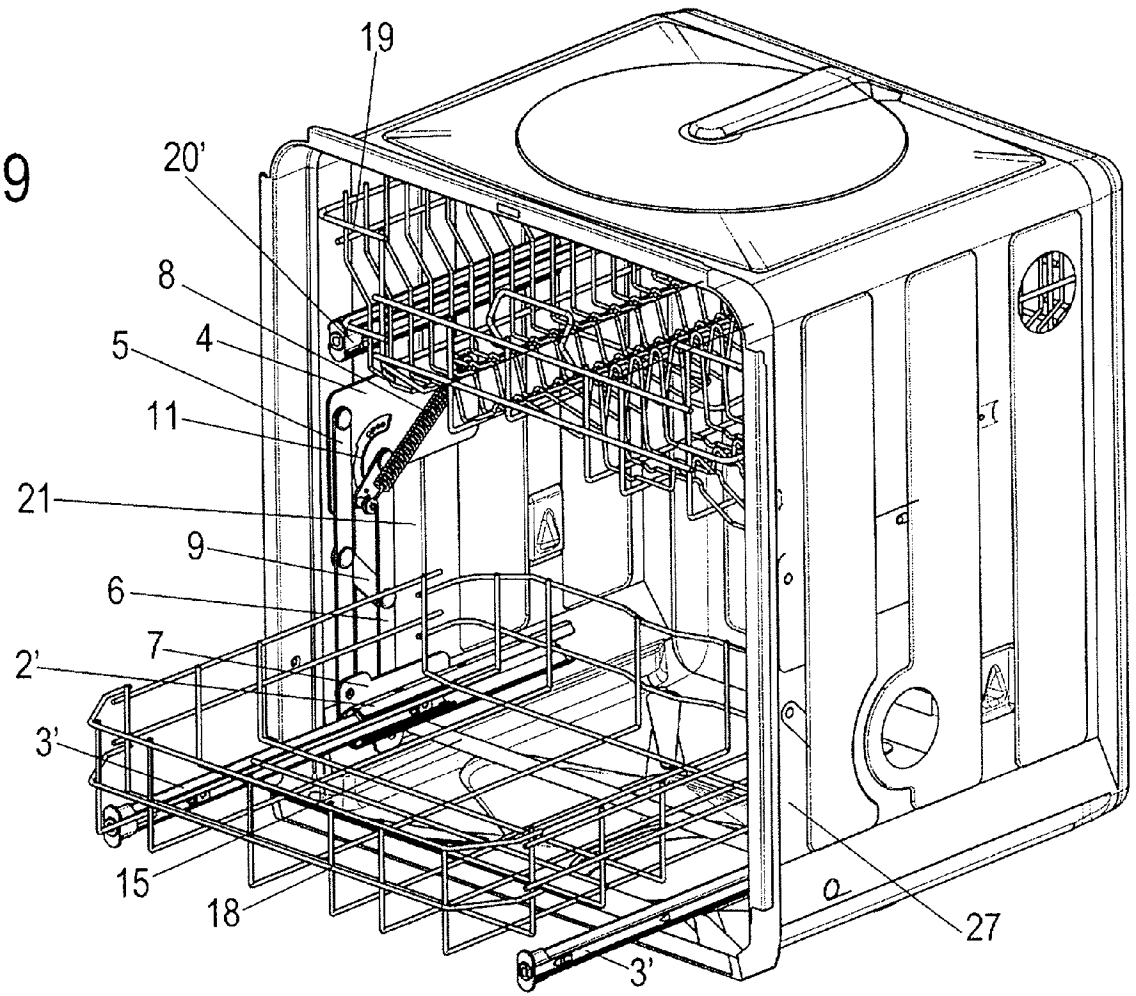
Figure 10:
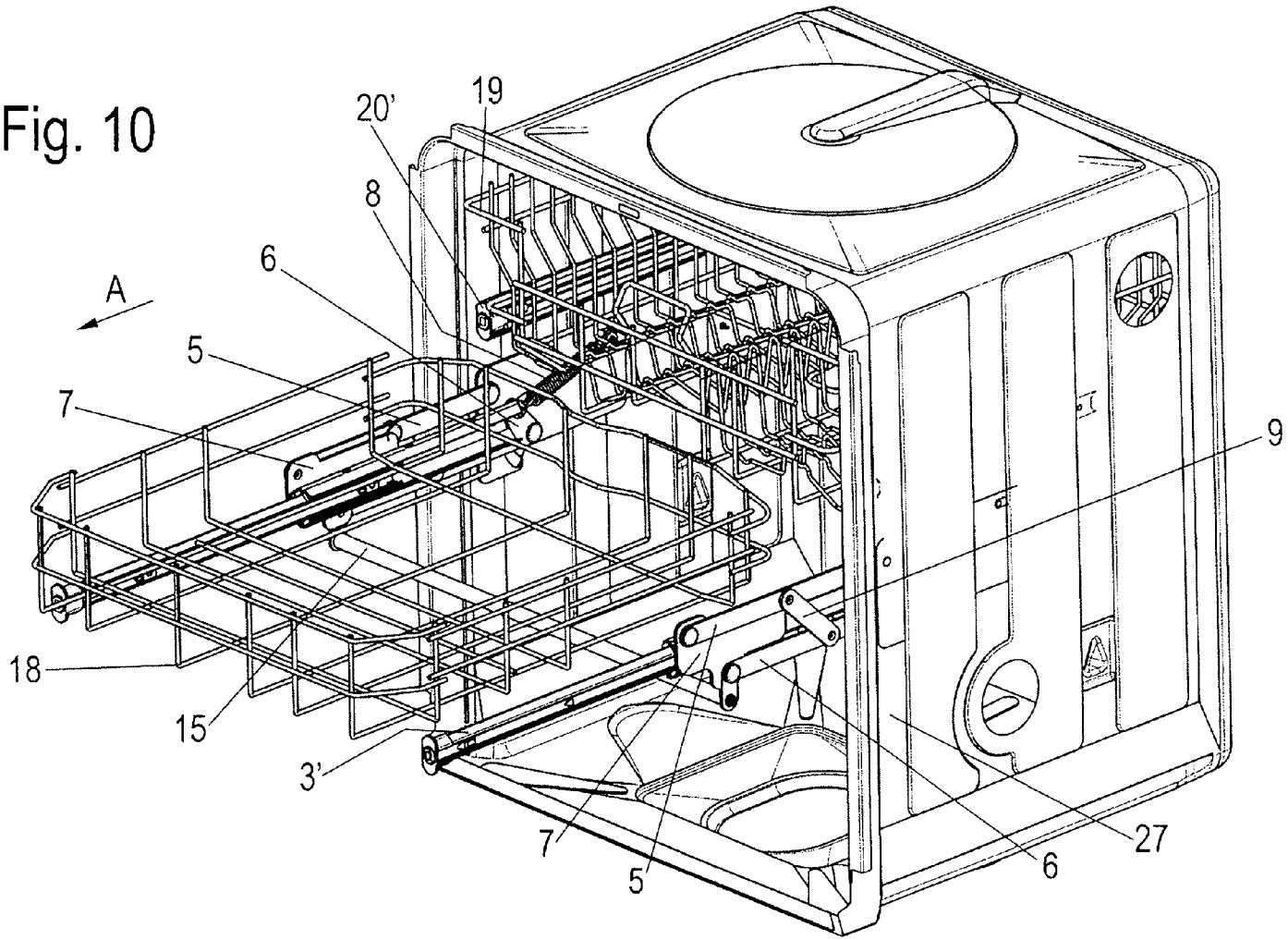

FIGS. 5 to 7 show a household device with an embodiment of a height adjustment mechanism 1 and an apparatus for height adjustment which is mounted therein. The household device can be a baking oven, as shown, for example in FIGS. 5-7, with a counter 18. The counter 18 may be arranged as a cooking item support, as shown in FIG. 3 and which may be used in the baking oven of FIGS. 5 to 7. Or, the household device may be a dishwasher with a counter 18 which is formed as a dishwasher rack 19, as is shown in FIGS. 8 to 10. FIG. 5 shows the height adjustment mechanism 1 in an initial position in which the counter 18 is fully retracted in the household device behind a front door 17. The two arms 5, 6 of the height adjustment mechanism 1 are positioned vertically and parallel at a distance from one another in this position of the counter 18. The tension spring 8 is tensioned maximally in this position and a portion of its central axis lies beneath a pivot point of arm 6.

At a beginning of a lifting process, the counter 18, which is connected with the sliding rails 3 of the pull-out guide 20, 20', can be pulled out of the household device in the pull-out direction A on the guide rails 2, 2'. Such a position of the counter 18 is shown in FIG. 9. After reaching a limit stop, a lifting of the counter 18 will occur with the help of the height adjustment mechanism 1 following further withdrawal of the counter 18 out of the household device. Such a position is shown in FIG. 6. In this process, the arms 5, 6 have already been rotated clockwise by an angle out of their vertical initial position. As a result of the rotation of the arm 6, the central axis of the tension spring 8 travels beyond the pivot point of arm 6 on the side wall fixture 4, whereupon the tension spring 8 will support the lifting.

In the position as shown in FIGS. 7 and 10, the counter 18 has reached its lifted end position. The arms 5, 6 will stand horizontally or at least virtually horizontally. The tension spring 8 is virtually relaxed in this position. Convenient loading and unloading of the counter 18 by a user is enabled in this position of the counter 18.

Figure 11:
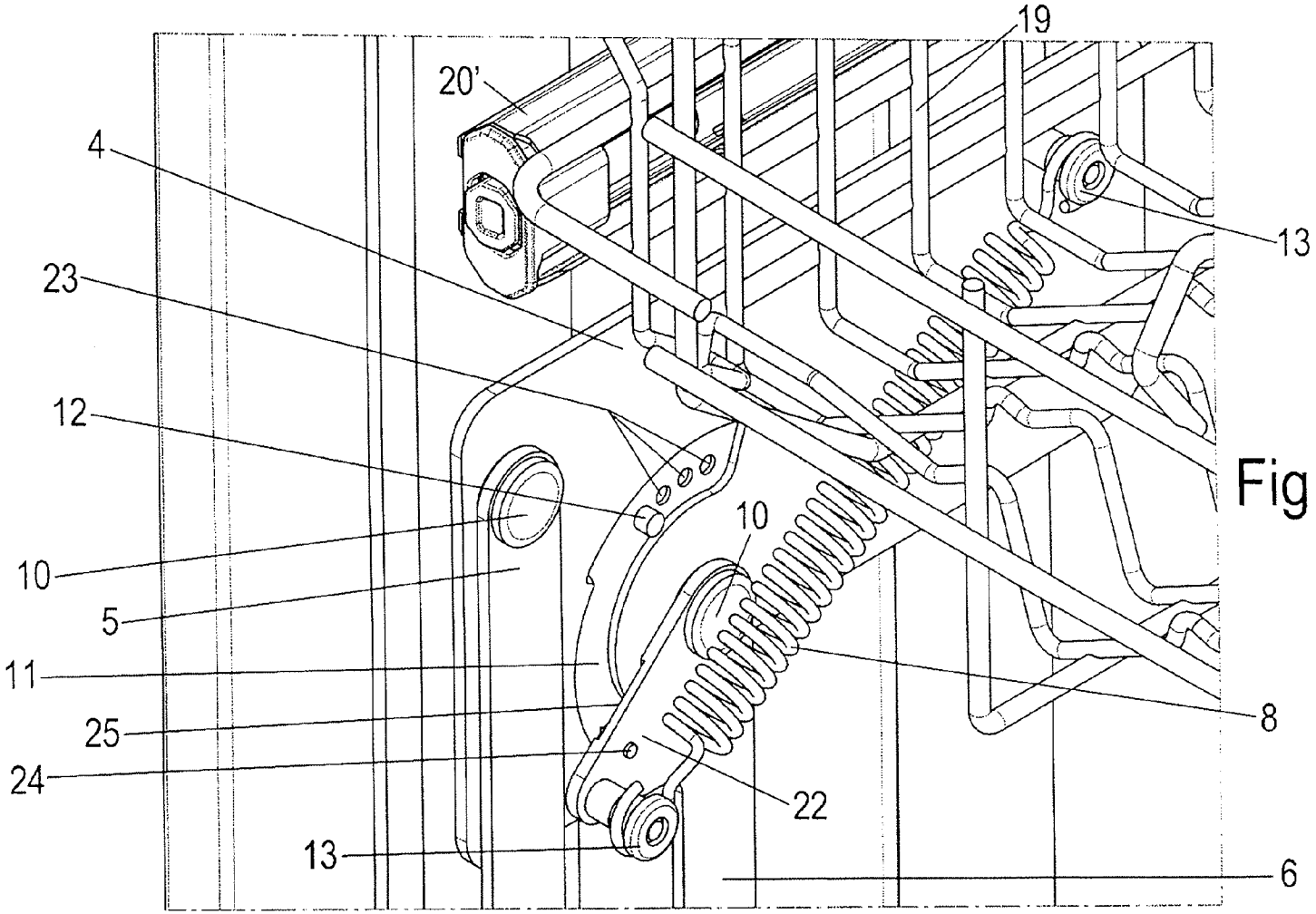
FIGS. 11 to 13 show schematic perspective detailed views of the holding plate of the height adjustment mechanism with guide, energy storage device and locking element, according to an embodiment of the present disclosure.
Figure 12:
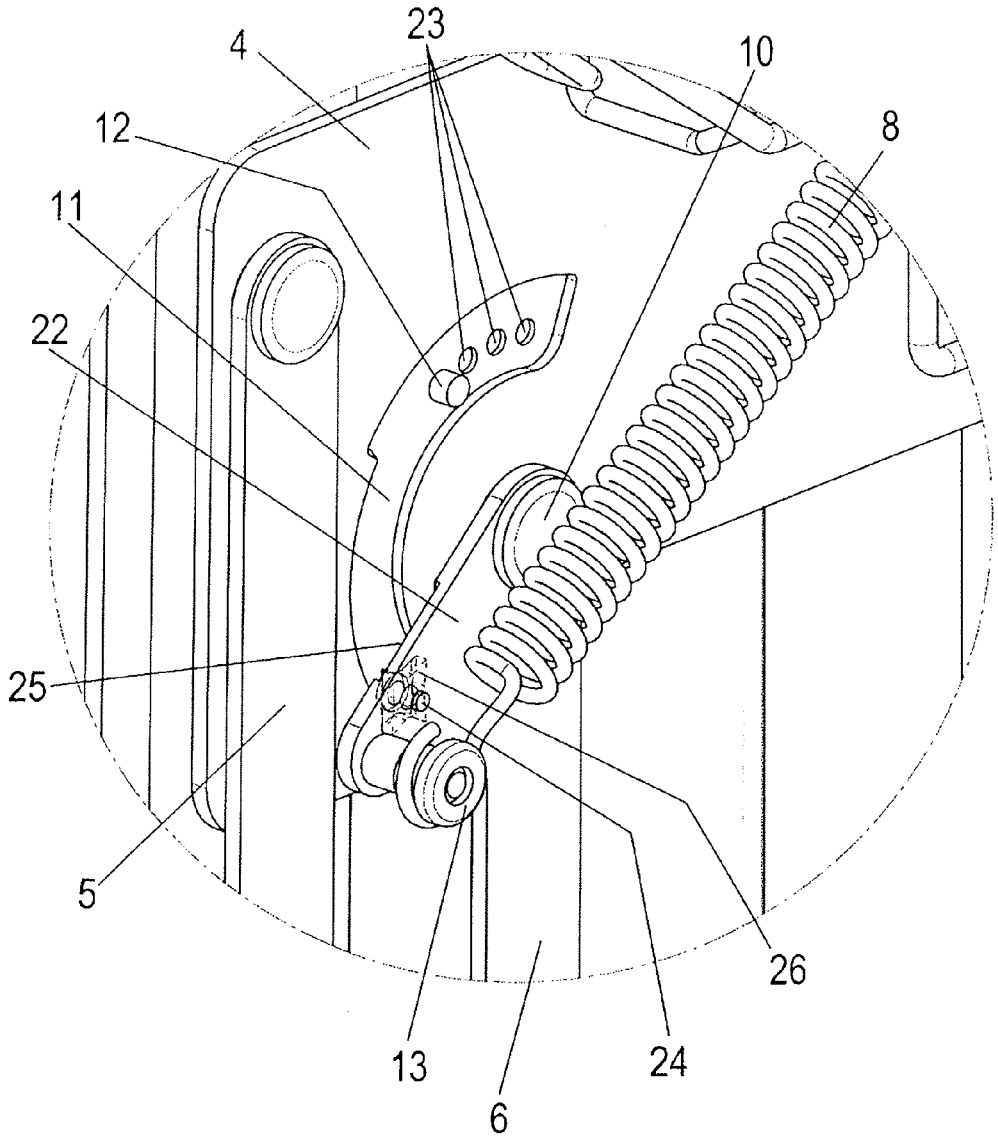
Figure 13:
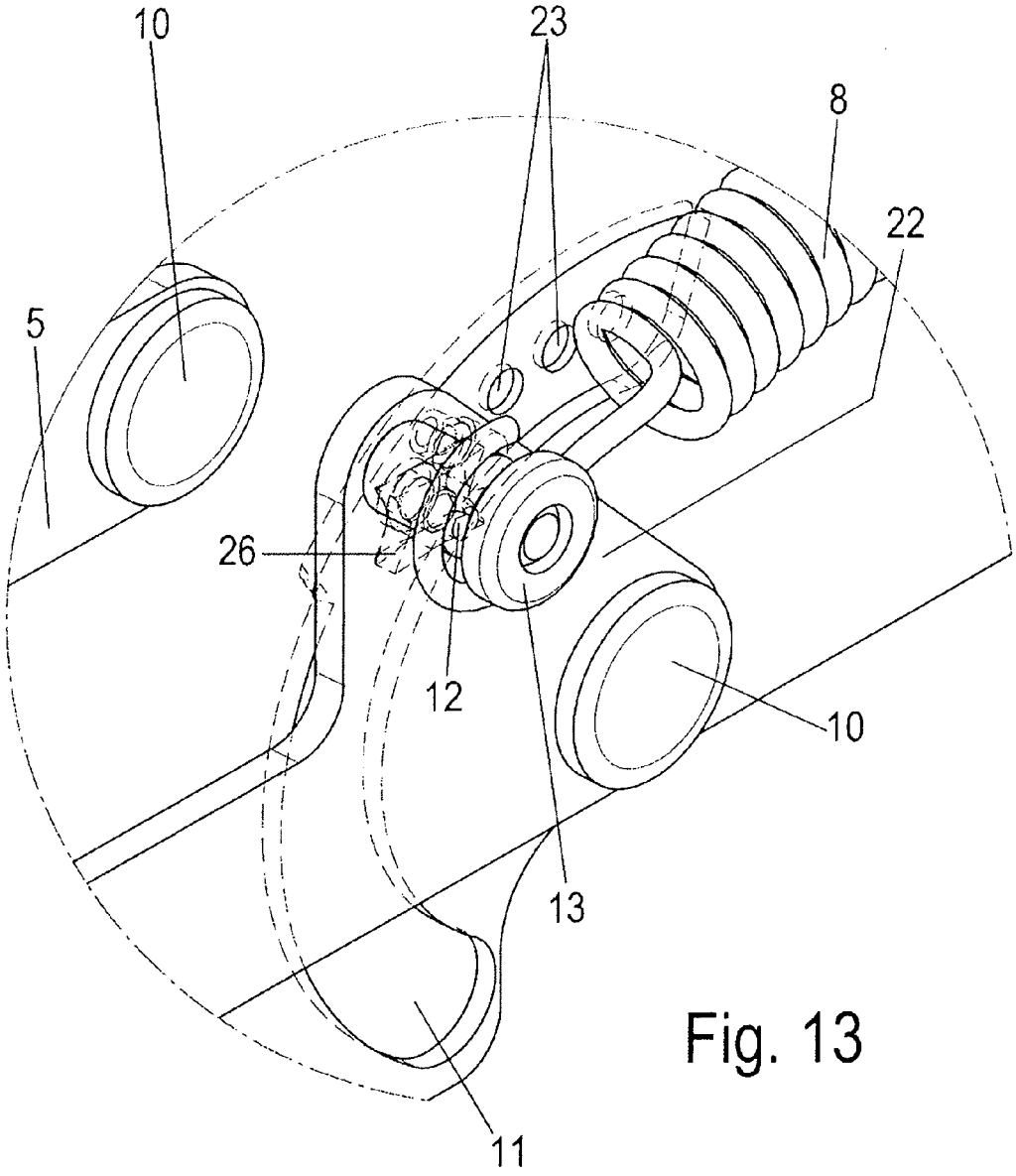

In order to lock the height adjustment mechanism 1 in an end position, the height adjustment mechanism 1 includes a locking mechanism, as shown in FIGS. 11 to 13. This locking mechanism includes a locking element 12 which is provided in an end region of the guide 11. The guide 11 may be arranged as a guide groove shaped in the manner of a circular arc, with the head element 22 of the arm 6, which is at the rear in the pull-out direction A, being fixed to the side wall fixture 4 at the position of a center of the circle of the guide groove 11 shaped in the manner of the circular arc. The locking element 12 may be arranged as a bolt which can be slid into the guide groove 11 of a guide element 26 and can automatically be locked. Guide element 26 protrudes from head element 22 of the arm 6 which is at the rear in the pull-out direction A and protrudes into the guide 11 which is incorporated in the side of the side wall fixture 4 which faces away from the side wall 21, 27 of the household device. The head element 22 also includes a recess 25 for housing the guide element 26 in this region in a compact way. An unlocking element 24 is provided on the side of the head element 22 which faces away from the side wall fixture 4, with which the locking can be released again.

In order to enable the performing of optional variations in the lifting height of the counter 18, according to the present disclosure, bores 23 may be provided in the guide 11. This allows different positioning of the locking element 12. The head element 22 of the arm 6 in the guide 11 can be displaced more or less further up in the guide 11 depending on the bore 23 in which the bolt 12 is arranged, which is accompanied with an adjustment of the lifting height.

As is shown in FIGS. 9 and 10, the height adjustment mechanism 1 is arranged in such a way that a second dishwasher rack 19, which can be pulled out of the dishwasher by way of a pull-out guide 20', can be housed in such a household device without impairing the lifting capability of the bottom counter 18 with respect to its function.

A groove 14 is provided in the side wall fixture 4, in the embodiment of FIGS. 1 and 3, for example, for setting a tensile force of the tension spring 8, in which the bolt 13 holding the tension spring 8 can be locked in a horizontally adjustable manner. The tensile force can thereby be adjusted individually in a simple way for supporting the lifting of the counter 18.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. An apparatus for adjusting the height of at least one counter, the at least one counter guided in a household device by at least one pull-out guide, the apparatus comprising:

at least one sliding rail on which the at least one counter is guidable and configured to be pulled out in a pull-out direction;

a height adjustment mechanism configured to be fixed to opposing side walls of the household device;

the height adjustment mechanism including two arms which are rotatably fixed to each of the side walls with first ends of the arms being parallel to a plane of the side walls and arranged to be spaced parallel with respect to each other;

two guide rails being fixable to respective second ends of the arms in a rotatable manner parallel to the plane of the side walls) in such a way that the guide rails are configured to be lifted from a bottom position in the household device to an upper position;

an energy storage device fixed to at least one of the opposing side walls of the household device, which energy storage device is in operative connection with one of the arms fixed to the at least one opposing side wall in such a way that one of a lifting and lowering of the guide rails is supportable by energy stored in the energy storage device;

a side wall fixture configured to be fixed to at least one of the opposing side walls of the household appliance, and to which side wall fixture the arms and the energy storage device of the height adjustment mechanism are fixed; and a guide located on a side of the side wall fixture which faces away from a respective one of the side walls of the household device, and in which guide a guide element is included and configured to be guided and which guide element protrudes from a head element of one of the arms.

2. The apparatus according to claim 1, wherein the energy storage device is a tension spring.

3. The apparatus according to claim 1, wherein the side wall fixture is configured as a holding plate.

4. The apparatus according to claim 1, wherein the guide is arranged as a guide groove shaped in the manner of a circular arc and the head element is fixed to the side wall fixture at a position of a center of a circle of the guide groove shaped in the manner of a circular arc.

5. The apparatus according to claim 1, wherein a locking element is provided in at least one end region of the guide, with which the arm and thereby the entire height adjustment mechanism is configured to be locked in an end position.

6. The apparatus according to claim 1, wherein the arms, which are arranged on the opposing side walls and to which the energy storage device is configured to be fixed, are connected with each other by a cross member.

7. The apparatus according to claim 1, wherein the second ends of each of the arms fixed to the side walls of the height adjustment mechanism are rotatably fixed to a rail fixture, and a respective one of the rail fixtures is fastened to a respective one of the guide rails.

8. The apparatus according to claim 1, further comprising a support member which connects the two arms with each other and is rotatably fixed to the arms in a plane parallel to the plane of the side walls, and which arms are arranged to be spaced from one another in parallel.

9. The apparatus according to claim 1, wherein the energy storage device is configured to be fixed in a horizontally adjustable manner to the side walls of the household device.

10. The apparatus according to claim 3, wherein the holding plate includes a groove in which the energy storage device is configured to be locked in a horizontally adjustable way.

11. The apparatus according to claim 1, further comprising a cross member configured to synchronize movement of the arms on a left and a right side of the height adjustment mechanism.

* * * * *